US010914106B2

(12) United States Patent
Salice

(10) Patent No.: US 10,914,106 B2
(45) Date of Patent: Feb. 9, 2021

(54) ACTUATION DEVICE FOR A LIFTING SYSTEM AND LIFTING SYSTEM FOR DOOR LEAVES OF FURNITURE

(71) Applicant: ARTURO SALICE S.P.A., Novedrate (IT)

(72) Inventor: Luciano Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 0 days.

(21) Appl. No.: 16/336,201

(22) PCT Filed: Sep. 20, 2017

(86) PCT No.: PCT/EP2017/073815
§ 371 (c)(1),
(2) Date: Mar. 25, 2019

(87) PCT Pub. No.: WO2018/060032
PCT Pub. Date: Apr. 5, 2018

(65) Prior Publication Data

US 2019/0242167 A1 Aug. 8, 2019

(30) Foreign Application Priority Data

Sep. 30, 2016 (IT) ..... 102016000098088

(51) Int. Cl.
*E05F 1/08* (2006.01)
*E05D 13/00* (2006.01)
(Continued)

(52) U.S. Cl.
CPC ..... *E05D 13/1238* (2013.01); *E05D 3/06* (2013.01); *E05F 1/1058* (2013.01); *E05F 3/104* (2013.01);
(Continued)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 5,971,514 A * 10/1999 Hayakawa ..... E05D 15/582 16/291
7,178,202 B2 * 2/2007 Hirtsiefer ..... E05F 1/1261 16/366
(Continued)

FOREIGN PATENT DOCUMENTS

CN 1918352 A 2/2007
CN 102027181 A 4/2011
(Continued)

OTHER PUBLICATIONS

International Search Report and Written Opinion dated Nov. 20, 2017 issued in PCT/EP2017/073815.
(Continued)

*Primary Examiner* — Chuck Y Mah
(74) *Attorney, Agent, or Firm* — Scully, Scott, Murphy & Presser, P.C.

(57) ABSTRACT

An actuation device for a lifting system for door leaves of furniture, the actuation device comprising a fixing plate that can be connected to the body of the piece of furniture, a supporting lever for the door leaf, which is connected, so that it can oscillate, to the fixing plate at a fulcrum and comprises, at the fulcrum, a connecting portion that extends eccentrically with respect to the fulcrum, and elastic means that comprise a body for accommodating at least one elastic element.

12 Claims, 7 Drawing Sheets

(51) Int. Cl.
*E05F 3/10* (2006.01)
*E05F 1/10* (2006.01)
*E05D 3/06* (2006.01)

(52) U.S. Cl.
CPC ..... *E05F 3/106* (2013.01); *E05Y 2201/638* (2013.01); *E05Y 2900/20* (2013.01)

(58) Field of Classification Search
CPC ..... E05F 1/14; E05F 3/20; E05F 3/104; E05F 3/106; E05D 3/06; E05D 3/16; E05D 11/00; E05D 13/1238; E05Y 2201/21; E05Y 2201/264; E05Y 2201/47; E05Y 2201/492; E05Y 2201/618; E05Y 2900/20; E05Y 2900/202; A47B 2220/0072; Y10T 16/5383; Y10T 16/547; Y10T 16/5476
See application file for complete search history.

(56) References Cited

U.S. PATENT DOCUMENTS 7,478,891 B2 * 1/2009 Hollenstein ..... E05F 1/1058 312/319.2
7,500,287 B2 * 3/2009 Brustle ..... E05F 1/1075 16/286
7,810,213 B2 * 10/2010 Brustle ..... E05F 1/1075 16/286
8,256,064 B2 * 9/2012 Blersch ..... E05F 1/1253 16/286
8,321,996 B2 * 12/2012 Hirtsiefer ..... E05D 15/46 16/286
8,572,811 B2 * 11/2013 Lautenschlager ..... E05D 3/14 16/370
8,894,162 B2 * 11/2014 Kashiwaguma ..... E05F 1/1058 312/319.2
8,959,709 B2 * 2/2015 Hasegawa ..... E05D 3/14 16/65
9,228,384 B2 * 1/2016 Bonomie ..... E05F 3/20
9,498,062 B2 * 11/2016 Baldreich ..... E05D 11/1064
2001/0039762 A1 * 11/2001 Giovannetti ..... E05F 1/1091 49/246
2002/0108311 A1 * 8/2002 Salice ..... E05D 15/262 49/371
2004/0239213 A1 * 12/2004 Hirtsiefer ..... E05F 1/1058 312/109
2005/0218383 A1 * 10/2005 Hirtsiefer ..... E05F 1/1058 254/1
2006/0284530 A1 * 12/2006 Hollenstein ..... E05F 1/1058 312/327
2008/0121490 A1 * 5/2008 Dubach ..... E05F 5/00 192/17 D
2008/0216289 A1 9/2008 Salice
2010/0162847 A1 * 7/2010 Gassner ..... E05F 1/1058 74/490.07
2012/0000130 A1 1/2012 Kashiwaguma
2012/0260461 A1 * 10/2012 Lautenschlager ..... E05F 5/10 16/352
2013/0031746 A1 * 2/2013 Hasegawa ..... E05F 1/1261 16/50
2014/0319987 A1 * 10/2014 Blum ..... E05F 1/12 312/319.2
2015/0351539 A1 12/2015 Baldreich et al.

FOREIGN PATENT DOCUMENTS

CN 101351609 B 2/2013
CN 103109029 A 5/2013
EP 148 200 A2 10/2001
EP 1296011 A1 3/2003
EP 1766172 B1 11/2008
EP 1 999 328 B1 12/2009
EP 2402536 A1 1/2012
EP 1713996 B1 3/2014
WO WO 2006/005086 A1 1/2006
WO WO-2007042094 A1 * 4/2007 ..... E05D 3/16
WO 2012/116866 A1 9/2012

OTHER PUBLICATIONS

Italian Search Report dated Jun. 8, 2017 issued in IT 201600098088, with partial translation.
Chinese Office Action dated Mar. 31, 2020 received in Chinese Patent Application No. 201780060853.6.
Taiwanese Examination Report & Search Report dated Sep. 14, 2020 received in Taiwanese Patent Application No. 106132624, together with an English-language translation.
Chinese Office Action dated Oct. 12, 2020 received in Chinese Patent Application No. 201780060853.6.

* cited by examiner

ACTUATION DEVICE FOR A LIFTING SYSTEM AND LIFTING SYSTEM FOR DOOR LEAVES OF FURNITURE

CROSS-REFERENCE TO RELATED APPLICATIONS

This Application is a 371 of International Application PCT/EP2017/073815, filed on Sep. 20, 2017, which claims priority to Application IT 102016000098088 filed on Sep. 30, 2016.

BACKGROUND OF THE DISCLOSURE

The present invention relates to an actuation device for a lifting system and to a lifting system for door leaves of furniture, in particular door leaves that swing upward about a horizontal axis.

In the furniture sector, the use is known of lifting systems that comprise at least one supporting lever, which at a first end is supported, so that it can oscillate, by a fixing plate that can be anchored to a side wall of the item of furniture, while at the opposite end it can be connected, so that it can oscillate, to the door leaf of the item of furniture.

An example of such lifting systems is described in EP1766172, which teaches to use a gas-operated spring, connected between the fixing plate and the supporting lever, in order to provide the necessary force to lift the door leaf.

This solution, although functional, displays some drawbacks, which are linked mainly to the cost of the gas-operated spring and to the fact that, with use, this spring loses efficacy.

In order to overcome these drawbacks, solutions have been developed over time which, in place of the gas-operated spring, entail the use of elastic devices that comprise one or more helical springs, which are lower cost and which on average have a longer life.

Solutions of this type are shown for example in WO 2006/005086 or in EP 1713996; the elastic devices with helical springs specified therein cooperate with adapted transmission means connected to the fixing plate in order to transmit the force of the helical springs to the supporting lever of the system.

However, even these solutions are not free from drawbacks, which lie in particular in the complexity of the transmission means specified.

Another drawback is linked to the fact that the fixing plates commonly used for gas-operated springs need to be substituted by others that are specifically made for the connection of transmission means, for example in the form of movable sliders; if substituting a system using a gas-operated spring with one of the conventional systems using a helical spring, it is therefore necessary to substitute the entire assembly, often needing to provide new fixing points on the item of furniture as well.

Another drawback is linked to the fact that such lifting systems have low, or non-existent, versatility, since they cannot be adapted, without extensive modifications, to different types of movement of the door leaf from the designed movement.

From the above brief examination of the conventional solutions in the known art, it therefore emerges that there is a need to have an alternative to the conventional lifting systems, which overcomes the drawbacks explained above.

BRIEF SUMMARY OF THE DISCLOSURE

The aim of the present invention is to provide an actuation device and a lifting system that comprises such device which solves the above mentioned technical problems, compensates for the drawbacks and overcomes the limitations of the known art, by making it possible to make available a lifting system that is simple in construction and effective.

Within this aim, an object of the invention is to provide an actuation device and a lifting system that comprises such device that has elastic means that are low cost and reliable and which do not require any substantial modification to fixing plates or more generally to lifting systems already in use, and/or which can be easily substituted for these.

Another object of the invention is to provide an actuation device and a lifting system that comprises such device that can easily be adapted to different types of movement of the door leaf, by way of simple modifications of one or, at most, a few parts.

Another object of the invention is to provide an actuation device and a lifting system that comprises such device that is reliable over time and which offers a lifting force that can be adjusted in order to adapt it to different weights of door leaves or installation needs.

This aim and these and other objects which will become better apparent hereinafter are achieved by an actuation device for a lifting system for door leaves of furniture, said actuation device comprising:

a fixing plate that can be connected to the body of the piece of furniture, a supporting lever for the door leaf, which is connected, so that it can oscillate, to the fixing plate at a fulcrum and comprises, at the fulcrum, a connecting portion that extends eccentrically with respect to the fulcrum, elastic means that comprise a body for accommodating at least one elastic element, characterized in that the actuation device comprises an intermediate connecting lever that comprises two opposite ends, a first end of the intermediate connecting lever being coupled, so that it can oscillate, to the connecting portion of the supporting lever, at a first pivot, the body of said elastic means having at least one first end which is coupled, so that it can oscillate, to the fixing plate and a second, opposite end that has a second pivot, a second end of the intermediate connecting lever being coupled, so that it can oscillate, to the body of said elastic means, at the second pivot, said intermediate connecting lever comprising an actuation surface or cam which is arranged substantially at the second pivot, said elastic means comprising furthermore a pusher that is supported so that it can move longitudinally by said accommodation body and is pressed by the at least one elastic element, said cam cooperating with said pusher.

In this manner, an actuation device and a lifting system that comprises such device can be obtained which overcome the limitations of the conventional systems, since they are relatively easy to manufacture and install, as well as being reliable.

The actuation device according to the invention and the lifting system that comprises such device, furthermore, do not require substantial modifications to fixing plates or more generally to lifting systems already in use, and can be easily substituted for the latter.

Last but not least, such actuation device, and the corresponding lifting system that comprises such device, can easily be adapted to different types of movement of the door leaf, by way of simple modifications of one or, at most, a few parts.

Furthermore, the actuation device according to the invention and the lifting system that comprises such device have a lifting force that can be adjusted in order to easily adapt it to different weights of door leaves or installation needs, and they can be used if, in order to move the door leaf, it is necessary to have powerful forces and/or precise control of the movement of the door leaf and/or of the variation of the lifting force.

Last but not least, the actuation device according to the invention can be easily substituted for the gas-operated springs of existing systems, thus constituting an advantageous retrofit of such systems, and it is simple to install, robust, and low cost.

Finally, the actuation device according to the invention and the lifting system that comprises such device are a valid alternative to conventional lifting systems.

Further characteristics and advantages of the invention will become better apparent from the description of four preferred, but not exclusive, embodiments of the lifting system that comprises the actuation device of the invention, which are illustrated by way of non-limiting example with the aid of the accompanying drawings wherein:

DETAILED DESCRIPTION OF THE DISCLOSURE

Figure 4:
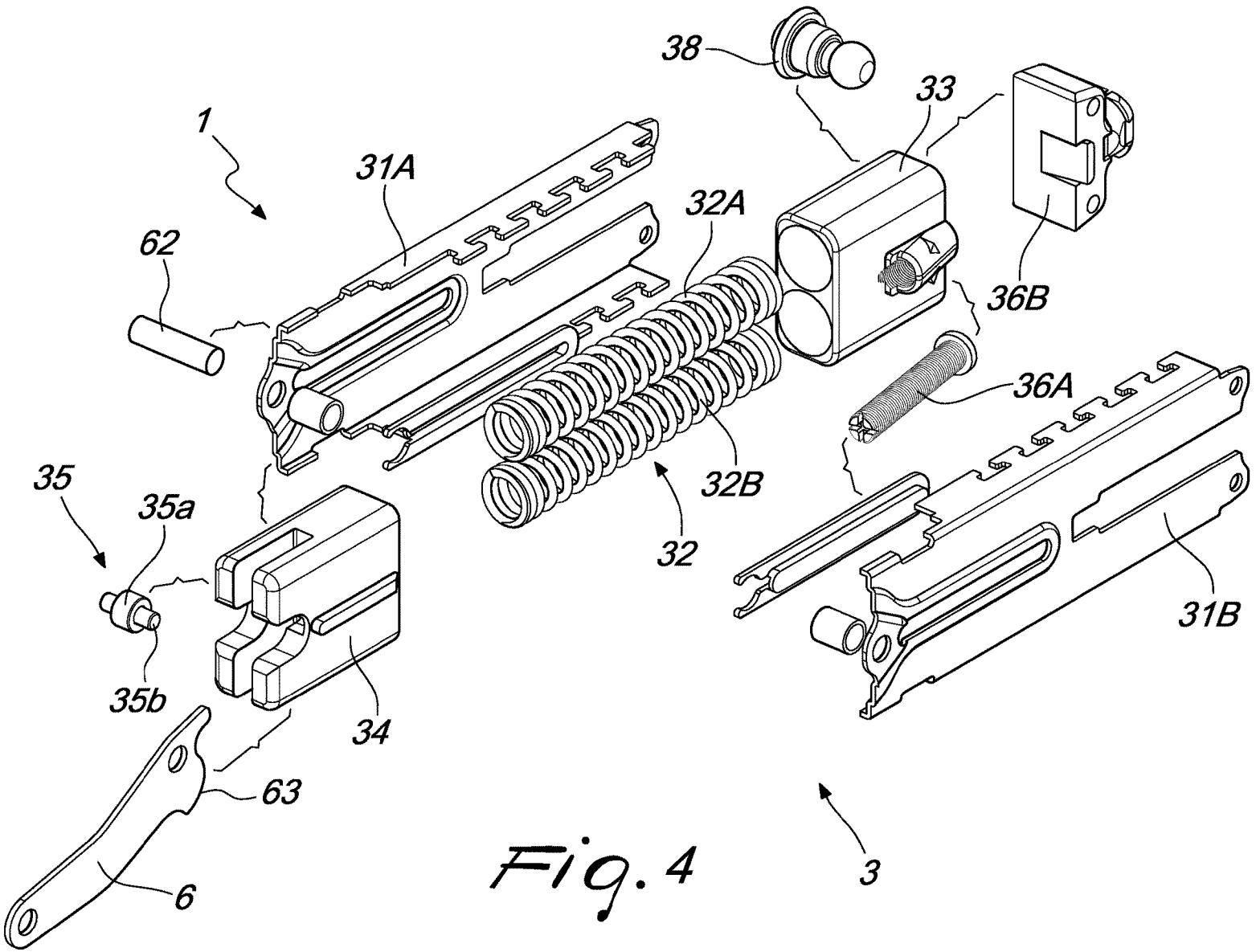
FIG. 4 is an exploded view of part of the actuation device in the previous figure.
Figure 5:
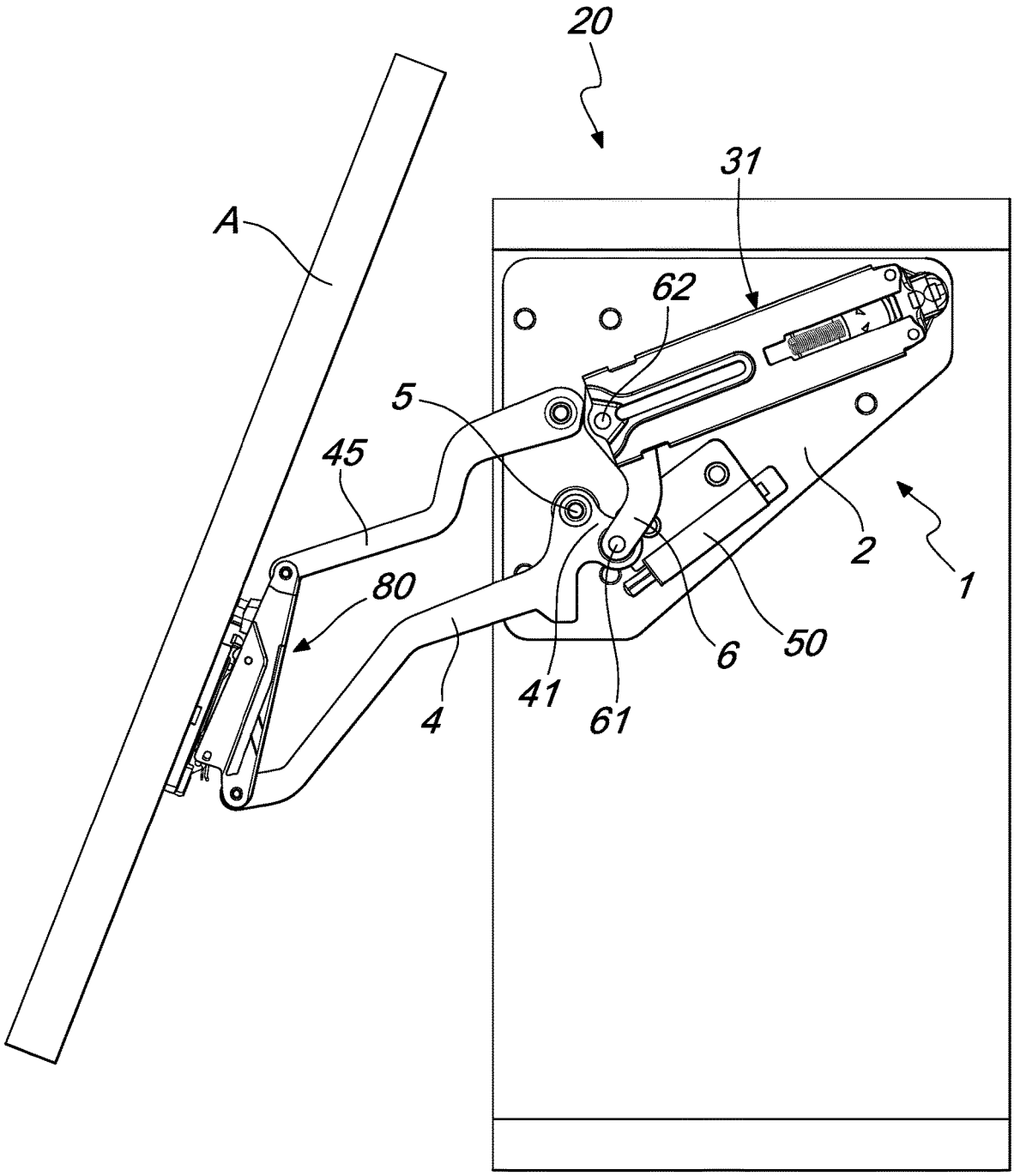
FIG. 5 is a side view of a second embodiment of a lifting system, according to the invention, which is installed on a piece of furniture with a door leaf that opens by tilting.
Figure 6:
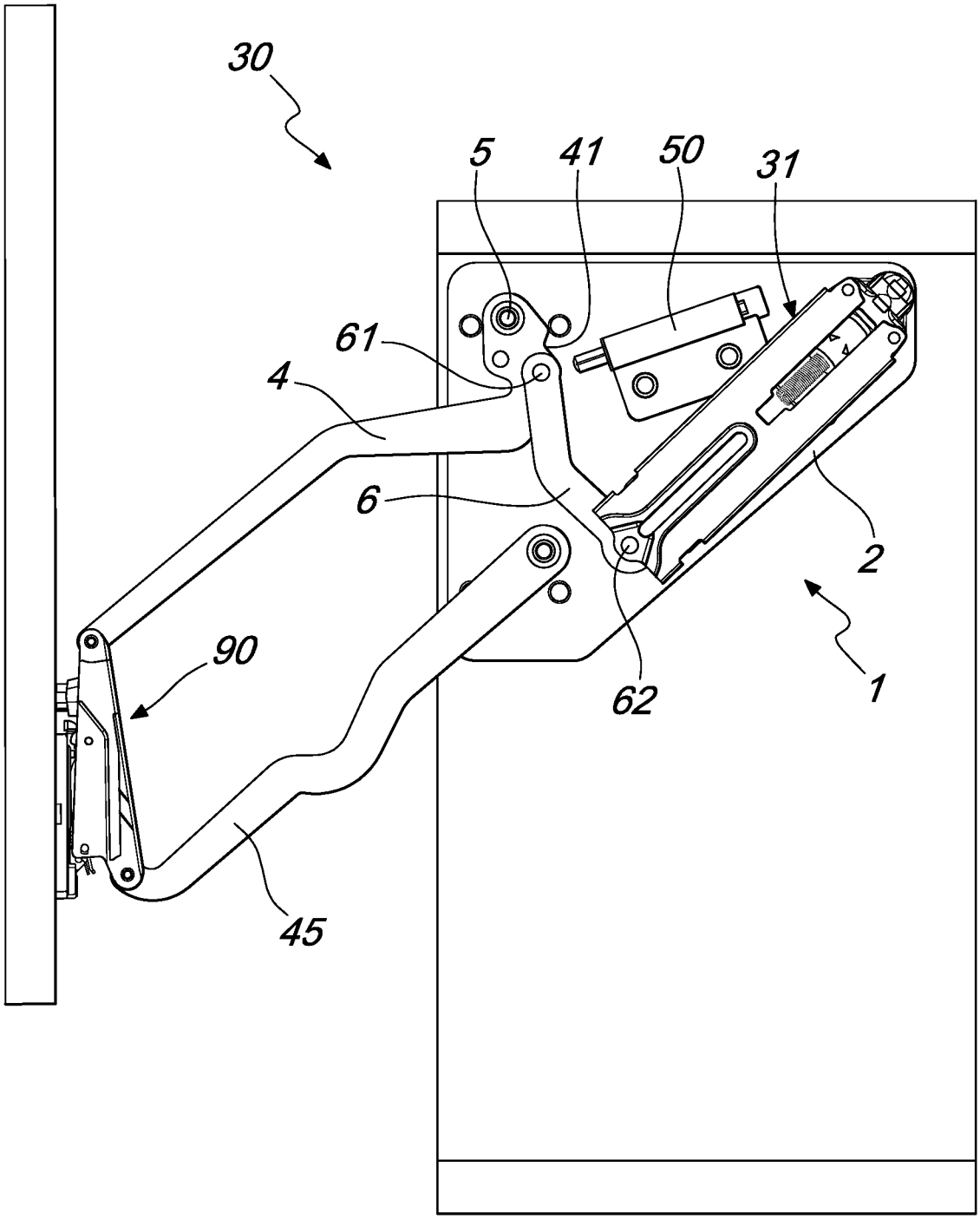
FIG. 6 is a side view of a third embodiment of a lifting system, according to the invention, which is installed on a piece of furniture with a door leaf that opens by parallel movement.
Figure 7:
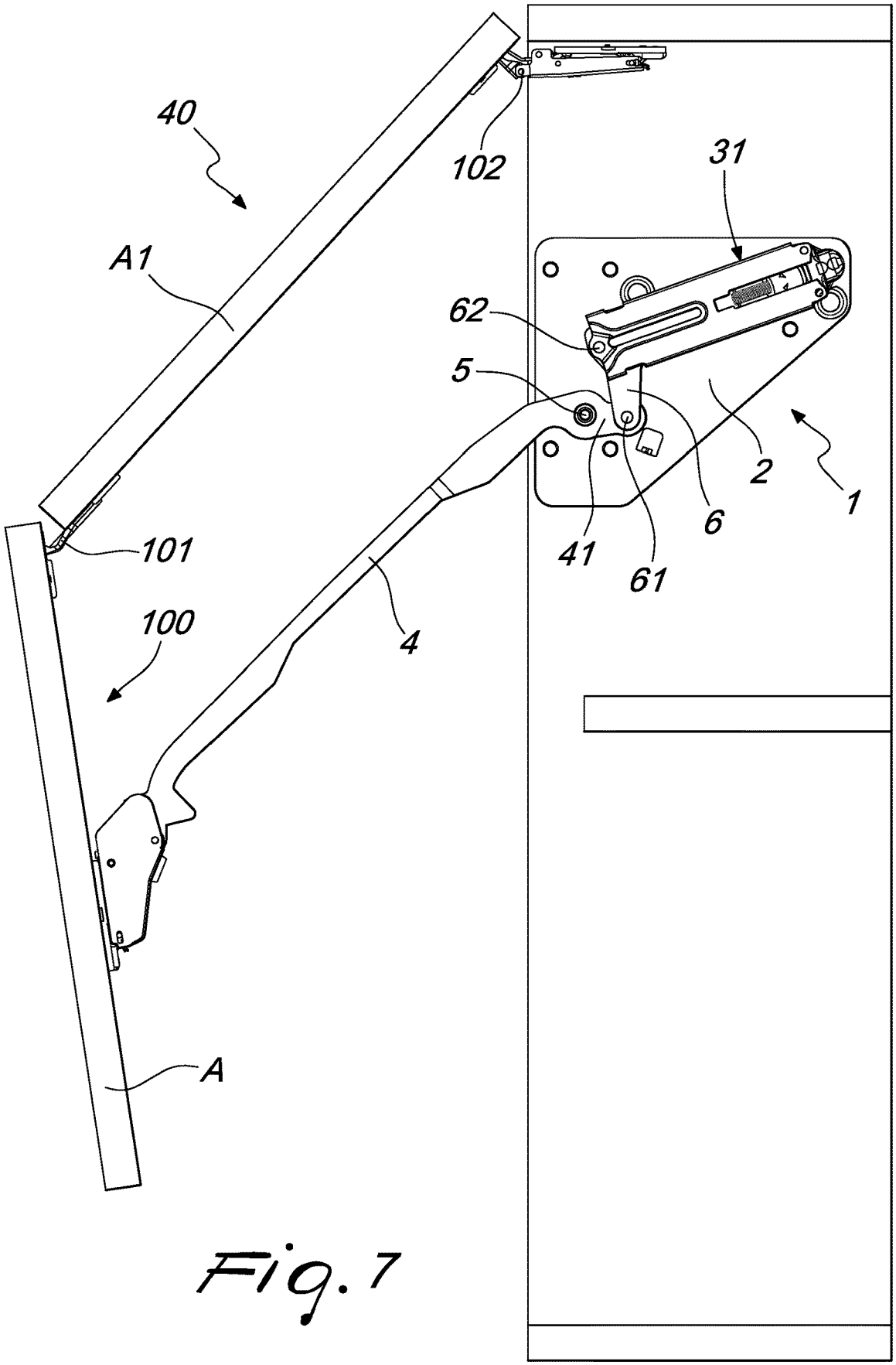
FIG. 7 is a side view of a fourth embodiment of a lifting system, according to the invention, which is installed on a piece of furniture with a door leaf that opens by tilting and folding.

With reference to FIGS. 1-4, a first embodiment of a lifting system, generally designated by the reference numeral 10 is shown, while FIGS. 5, 6 and 7 show alternative embodiments which are generally designated by the reference numerals 20, 30 and 40.

Generally, in all the various embodiments, the lifting system 10, 20, 30 and 40 is adapted to be applied to door leaves A of furniture M, in particular door leaves that tilt upward about a horizontal axis.

The system 10, 20, 30 and 40 comprises at least one actuation device 1 according to the invention, which is substantially equivalent for all the embodiments.

The actuation device 1 comprises a fixing plate 2 that can be connected to the body of the piece of furniture M.

In particular the plate 2 is intended to be fixed to a shoulder of the piece of furniture and is provided with adapted fixing means (in the examples shown these are constituted by holes for accommodating screws, but they could equivalently be pins that protrude from a face of the plate 2 or combinations of pins and holes).

The device 1 also comprises a supporting lever 4 for the door leaf A, which is connected, so that it can oscillate, to the fixing plate 2 at a fulcrum 5.

The fulcrum 5 is provided for example with a pivot that engages the supporting lever 4 and the plate 2 in rotation.

The supporting lever 4 can be variously contoured, straight, curved or with mixed profiles, according to the installation requirements and to the type of door leaf; such details are not expanded on here as they are not essential to understanding the invention.

Note that the supporting lever 4 comprises, substantially at the fulcrum 5, a connecting portion 41 that extends eccentrically with respect to the fulcrum 5; the connecting portion 41 can be in the form of an arm that extends from the lever 4 (as in the systems 10, 20, 40) or a part integrated in the body of the lever 4 (as in the system 30); the function of the connecting portion 41 will become clearer shortly.

The device 1 also comprises elastic means 3 that comprise a body 31 for accommodating at least one elastic element 32.

In the embodiments illustrated, the body 31 is a box-like body provided by way of joining two metallic half-shells 31A and 31B, as shown in detail in FIG. 4; however, in other embodiments (not shown), the body 31 is provided differently and/or with different materials (e.g. plastic).

The elastic element 32, in the non-limiting embodiment shown, comprises two metallic helical springs 32A and 32B; in other embodiments there could instead be a single helical spring or other, equivalent types of elastic means. The advantages of using helical springs in place of gas-operated springs are, briefly, the low cost and the high reliability over time, as well as the ready availability on the market.

The springs 32A and 32B (or, more generally, the elastic element 32) extend between a rear base 33 and a front fork-like element 34, which also form part of the elastic means 3; as it will be made clearer below, the rear base 33 is integral or movable with respect to the body 31.

The latter has at least one first end that is coupled, so that it can oscillate, to the fixing plate 2, for example by virtue of the axis 38, so as to be able to rotate with respect thereto.

The elastic means 3 comprise furthermore a pusher 35 that is supported so that it can move longitudinally by the accommodation body 31 and is pressed by the at least one elastic element 32.

In the example shown, the pusher 35 comprises a roller 35*a* that can rotate about a short internal shaft 35*b*, which in turn is integral with the front fork-like element 34, so that the action of the springs 32A, 32B is carried out on the pusher 35.

In other embodiments, not shown, the pusher can instead be constituted by a different sliding element carried by the fork-like element 34.

The body 31 of the elastic means 3 also has a second end, which is opposite to the first one, and supports a second pivot 62.

An intermediate connecting lever 6, which is also part of the device 1, is articulated on the second pivot 62.

The lever 6 comprises a first end that is coupled, so that it can oscillate, to the connecting portion 41 of the supporting lever 4, at a first pivot 61, and a second end that is articulated in rotation to the body 31 by virtue of the second pivot 62.

The intermediate connecting lever 6 also comprises an actuation surface or cam 63 which is arranged substantially at the second pivot 62.

The cam 63 cooperates with the pusher 35, being pushed in abutment thereon by the action of the elastic element 32, so as to apply a lifting force generated by the latter to a kinematic chain that comprises (and preferably is constituted by) the pusher 35, the actuation surface or cam 63, the intermediate connecting lever 6, and the supporting lever 4, in order to thus apply a lifting force to the door leaf A through a connecting base, which is part of the lifting system, to which the kinematic chain is connected in order to transmit the lifting force from the elastic element 32 to the door leaf A.

The connecting base 70, 80, 90, 100 varies in the embodiments 10, 20, 30 and 40 and will be described later.

Returning to the cam 63 of the intermediate connecting lever 6, the contour and/or the overall shape structure of the lever 6 are chosen as a function of the law of variation of the lifting force that it is desired to obtain, so as to be able to lift and support the door leaves of various different types of furniture, and they can therefore vary as a function of such parameters; the person skilled in the art, in light of the information provided here, will without effort be able to choose the contour of the cam 63 and/or the shape structure of the intermediate lever 6.

In preferred embodiments, such as those shown and with reference to the embodiment 10 of the system of the invention, starting from a partially open position (preferably in the neighborhood of 10°-15° up until the position of maximum opening (FIG. 2), the pusher 35 moves along a curved portion of the cam 63 at which a force is exerted in the direction of opening, or lifting, of the door leaf A.

Below such partially open position, for example from 10° open up until the closed position (FIG. 1), the pusher 35 passes a cusp or change of slope of the cam 63 beyond which a force is exerted in the direction of closing, or lowering, of the door leaf A.

The angular intervals just indicated should be understood to be indicative and not limiting.

Note, incidentally, that the presence of the intermediate lever 6 and of the cam 63, which are provided in conformance to the invention, make it possible advantageously, with respect to other, conventional systems, to obtain powerful forces and a satisfactory control of the movement of the door leaf and of the variation of the lifting force.

Returning now to the rear base 33 for the abutment of the elastic element, in this example with the springs 32A and 32B, it, in some embodiments (not shown) is integral with respect to the body 31.

In other embodiments however, like the one shown, there are elements for preloading the helical spring or springs.

To this end, the rear base 33 can be moved with respect to the body 31 in a plurality of stable positions, so as to provide a preliminary compression of the elastic element 32.

In more detail, the rear base 33, which is supported so that it can move longitudinally by the accommodation body 31, has, on one side, a threaded hole for an adjustment screw 36A, one end of which rests against an abutment element 36B that is integral with the accommodation body 31.

In this manner, by actuating the screw 36A the rear base 33 is moved along the accommodation body 31, causing a variation of the length of the springs 32A, 32B and ultimately modifying their preloading.

Figure 1:
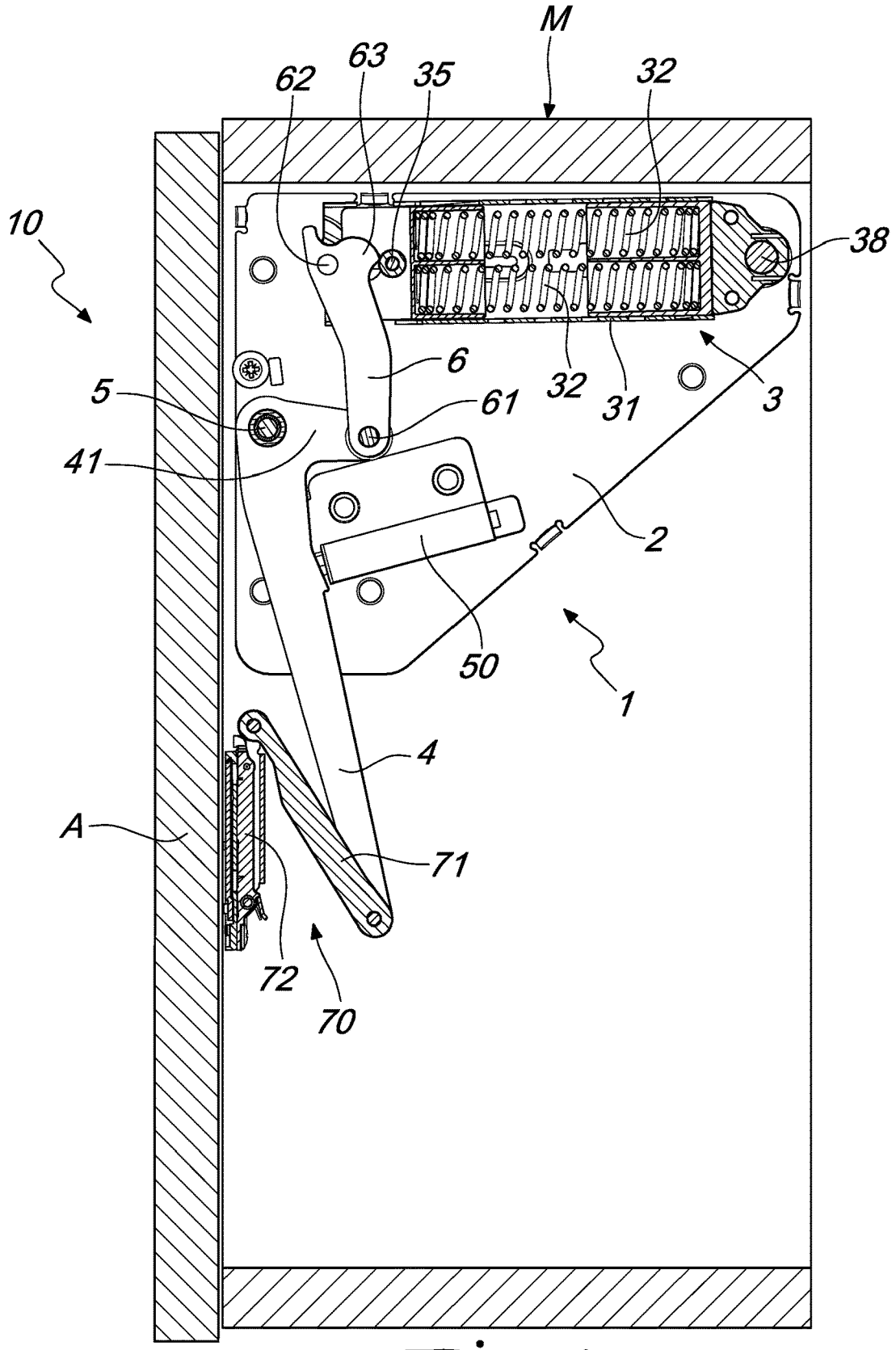
FIGS. 1 and 2 are cross-sectional views of a first embodiment of a lifting system according to the invention, which is installed on a piece of furniture with a door leaf of the tip-up type, in two operating conditions, respectively with the door leaf closed and with the door leaf open.
Figure 2:
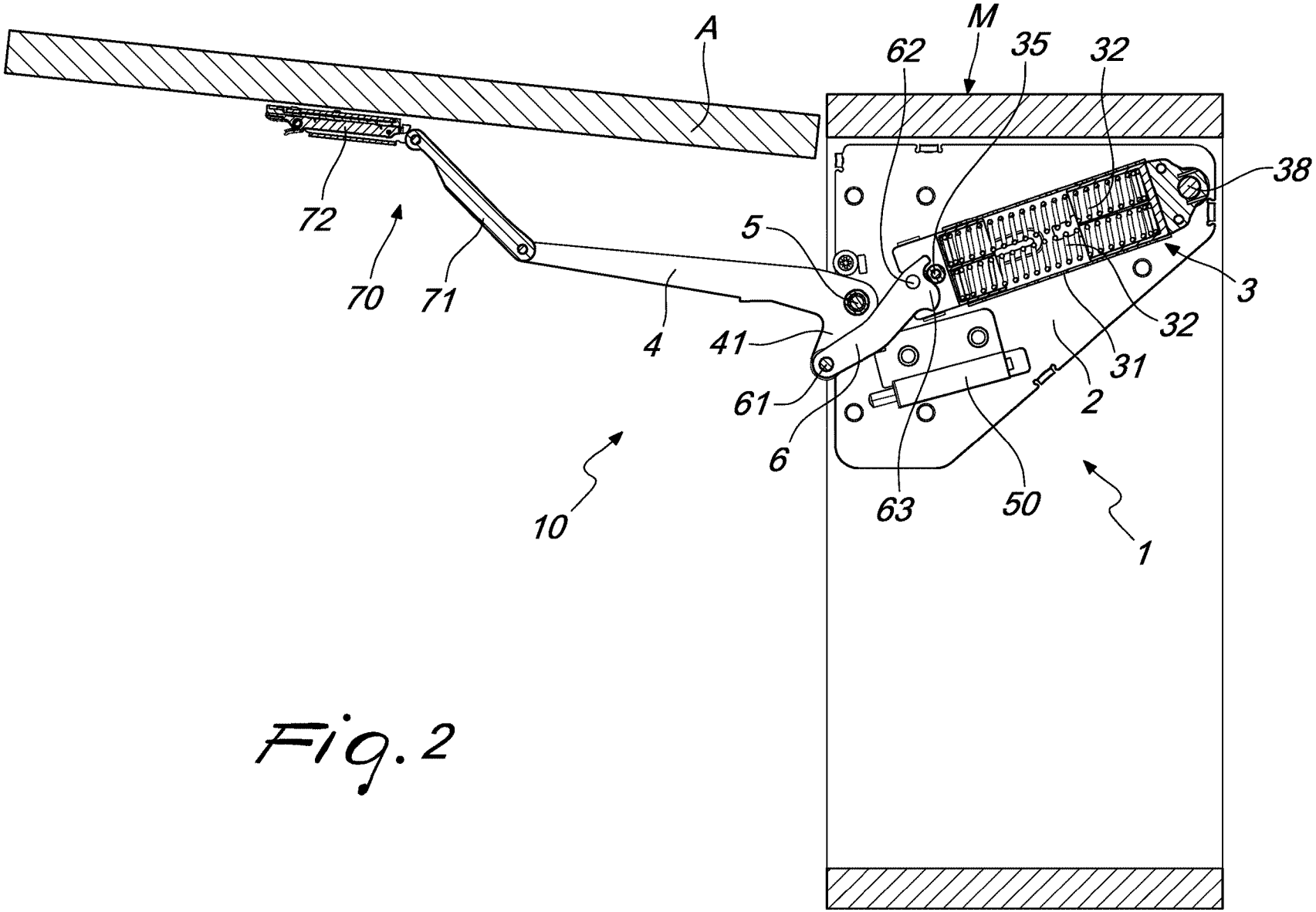
Figure 3:
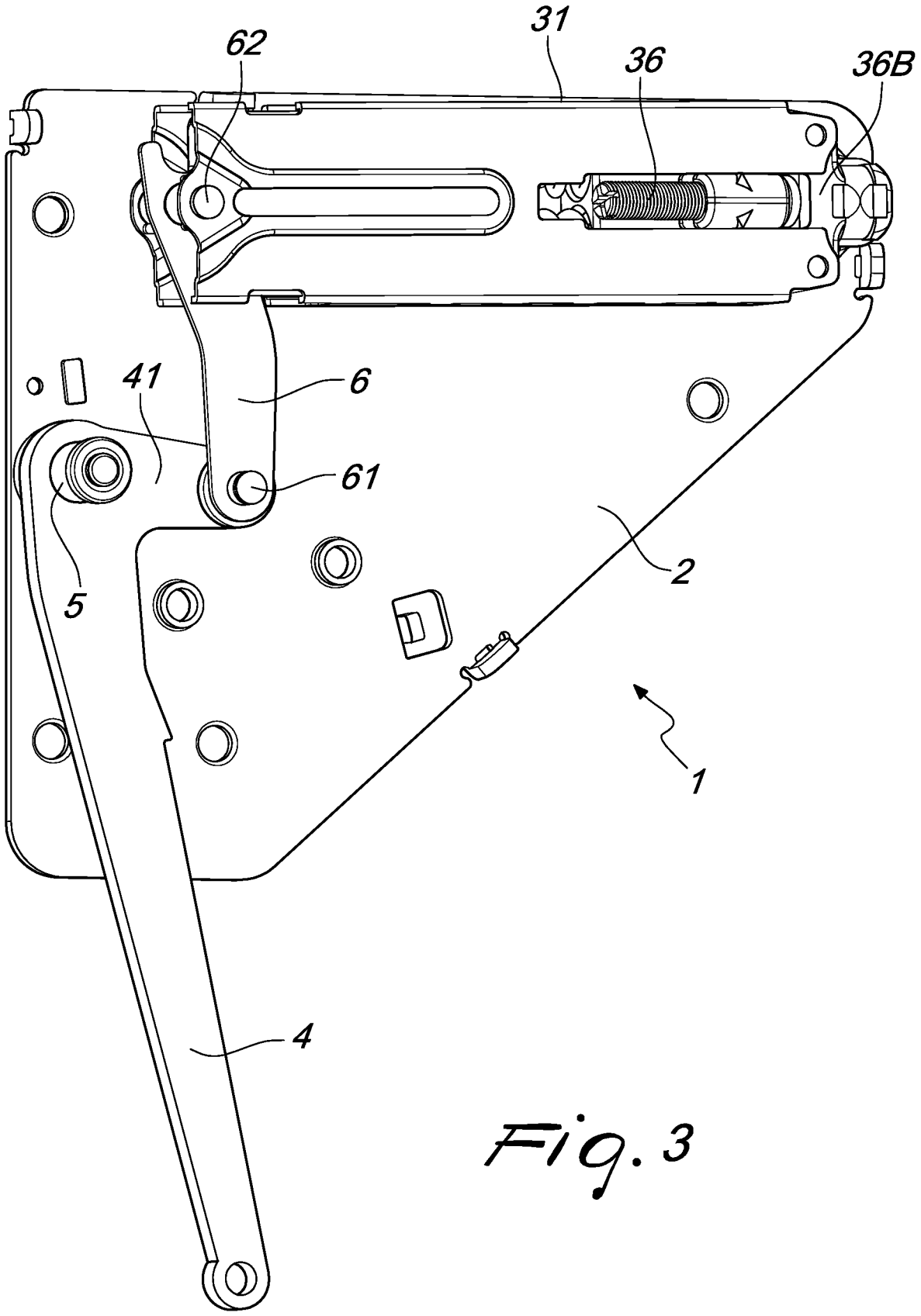
FIG. 3 is a perspective view of an actuation device, part of the lifting system in the previous figures.

With reference now specifically to the system 10 in FIGS. 1 and 2, in that system the door leaf A rotates about a horizontal axis in its lifting movement (from the condition in FIG. 1 to the condition in FIG. 2) thanks to the presence of hinges (not visible) in the sections shown.

Note that in this embodiment the system 10 preferably lacks other supporting arms that connect the door leaf A to the item of furniture M.

The connecting base, generally designated by the reference numeral 70, comprises a connection plate 72 for connection with the door leaf A, which is connected with the supporting lever 4 by way of an arm 71 that is articulated so that it rotates, at its ends, respectively to the connection plate 72 and to the supporting lever 4.

In this example, therefore, all the weight of the door leaf A is borne by the lever 4 of the system 10, which acts both to move and to support the door leaf A.

With reference now to the second embodiment of the system, designated with 20 in FIG. 5, the door leaf A is subject to a combined rotary and translational motion.

To this end, the system 20 comprises a connecting base 80 for connecting with the door leaf A and a second supporting lever 45 that oscillates and is articulated in rotation with the plate 2.

Both of the supporting levers 4 and 45 are connected and also oscillate with respect to the connecting base 80, so as to provide the desired movement.

With reference now to the third embodiment of the system, designated with 30 in FIG. 6, the door leaf A is subject to a rotary motion while remaining parallel to itself in the movement.

To this end, the system 30 comprises a connecting base 90 for connecting with the door leaf A and a second supporting lever 45 that oscillates and is articulated in rotation with the plate 2.

In this case too, similarly to the system 20, both of the supporting levers 4 and 45 are connected and also oscillate with respect to the connecting base 90; the difference between the two systems 20 and 30 lies in the shape structure and in the length of the levers 4, 45, 41 and in the arrangement of the supporting lever 4, which in the system 20 is below the lever 45, while in the system 30 is above the lever 45.

Finally, FIG. 7 shows the system in the embodiment 40, applied for moving a door leaf that opens by tilting and folding.

The door leaf in fact in this case is a double door leaf, and is made up of the door leaf A and the door leaf A1: the upper door leaf A1 is connected to the body of the piece of furniture M by way of separate and dedicate hinges 102 that form part of the system 40. The lever 4 on the other hand is coupled to the connecting base 100 fixed on the lower door leaf A, which in turn is hinged to the upper door leaf A1 by way of the hinge 101.

Optionally, one or more of the systems 10, 20, 30, 40 comprise furthermore a device 50 for decelerating the closing movement of the door leaf, for example in the form of a fluid-operated deceleration cylinder arranged on the fixing plate 2 in order to come into contact with the supporting lever 4, as shown in the example case of the systems 10, 20 and 30.

In the tilting and folding system 40, the deceleration device can be arranged inside the connecting base 100 in order to come into contact with an extension of the lever 4.

In practice it has been found that the lifting system, according to the present invention, achieves the intended aim and objects since it makes it possible to achieve the set aims.

Finally, note that the actuation device 1, which is common to all the embodiments 10, 20, 30, 40 of the lifting system, advantageously makes it possible to substitute the gas-operated spring of conventional lifting systems already in use, without the need for particular modifications to the other parts of those systems.

The lifting system thus conceived is susceptible of numerous modifications and variations all of which are within the scope of the appended claims.

Moreover, all the details may be substituted by other, technically equivalent elements.

In practice the materials employed, provided they are compatible with the specific use, and the contingent dimensions and shapes, may be any according to requirements.

The disclosures in Italian Patent Application No. 102016000098088 (UA2016A006967) from which this application claims priority are incorporated herein by reference.

The invention claimed is:

1. An actuation device for a lifting system for door leaves of furniture, said actuation device comprising:

a fixing plate that can be connected to the body of the piece of furniture, a supporting lever for the door leaf, which is connected, so that it can oscillate, to the fixing plate at a fulcrum and comprises, at the fulcrum, a connecting portion that extends eccentrically with respect to the fulcrum, elastic means that comprise a body for accommodating at least one elastic element, wherein the actuation device comprises an intermediate connecting lever that comprises two opposite ends, a first end of the intermediate connecting lever being coupled, so that it can oscillate, to the connecting portion of the supporting lever, at a first pivot, the body of said elastic means having at least one first end which is coupled, so that it can oscillate, to the fixing plate and a second, opposite end that has a second pivot, said body of said elastic means configured to rotate about an axis, a second end of the intermediate connecting lever being coupled, so that it can oscillate to the body of said elastic means, at the second pivot, said intermediate connecting lever comprising an actuation surface or cam which is arranged substantially at the second pivot, said elastic means further comprising a pusher that is supported so that it can move longitudinally by said accommodation body and is pressed by the at least one elastic element, said cam cooperating with said pusher.

2. The actuation device according to claim 1, wherein said at least one elastic element comprises at least one helical spring.

3. The actuation device according to claim 2, wherein the elastic means comprise elements for preloading the at least one helical spring.

4. The actuation device according to claim 1, wherein the elastic means comprise a rear base and a front fork-like element between which said at least one elastic element extends and acts, and wherein the pusher comprises a roller that is integral with the front fork-like element.

5. The actuation device according to claim 4, wherein the rear base is supported so that said rear base can move longitudinally by the accommodation body and has, on one side, a threaded hole for an adjustment screw, one end of which rests against an abutment element that is integral with the accommodation body.

6. The actuation device according to claim 1, wherein the cam has a profile such as to apply a lifting force or a lowering force to the door leaf as a function of an opening angle of the door leaf.

7. A lifting system for door leaves of furniture, comprising at least one actuation device according to claim 1.

8. The lifting system according to claim 7, further comprising a connecting base that can be coupled to the door leaf and is coupled to the supporting lever of said actuation device.

9. The lifting system according to claim 8, comprising a further connecting base for connection to the door leaf and a second supporting lever that oscillates and is articulated in rotation with the plate, said supporting levers being connected and also oscillating with respect to the connecting base.

10. The lifting system according to claim 8, further comprising a device for decelerating a closing movement of the door leaf, which comprises a fluid-operated deceleration cylinder arranged on the fixing plate or on the connecting base that is configured to contact the supporting level or an extension of the supporting lever.

11. The lifting system according to claim 7, further comprising a connecting base that comprises a plate for connection to the door leaf, the connecting base being connected with the supporting lever by way of an arm that is articulated to said connecting base and to the supporting lever.

12. The lifting system according to claim 7, further comprising hinges for double door leaves, wherein said door leaves comprise a first door leaf and a second door leaf which are mutually hinged, said hinges provided for articulating the second door leaf to the body of the piece of furniture and at least one connecting base that is fixed to the first door leaf, said supporting lever being coupled to said connecting base.

* * * * *